US007463159B2

(12) United States Patent
Hess et al.

(10) Patent No.: US 7,463,159 B2
(45) Date of Patent: Dec. 9, 2008

(54) FIRE DETECTOR

(75) Inventors: Kurt Hess, Wolfhausen (CH); Max Schlegel, Chur (CH)

(73) Assignee: Siemens Building Technologies AG, Zuerich (CH)

( * ) Notice: Subject to any disclaimer, the term of this patent is extended or adjusted under 35 U.S.C. 154(b) by 128 days.

(21) Appl. No.: 10/518,609

(22) PCT Filed: Jun. 13, 2003

(86) PCT No.: PCT/CH03/00381

§ 371 (c)(1),
(2), (4) Date: Jul. 27, 2005

(87) PCT Pub. No.: WO04/001694

PCT Pub. Date: Dec. 31, 2003

(65) Prior Publication Data

US 2006/0007009 A1 Jan. 12, 2006

(30) Foreign Application Priority Data

Jun. 20, 2002 (EP) ..... 02013657

(51) Int. Cl.
*G08B 17/10* (2006.01)

(52) U.S. Cl. ..... 340/628; 340/630; 340/632; 340/517; 340/521; 340/577; 340/691.1; 340/693.6; 356/337; 356/343

(58) Field of Classification Search ..... 340/628, 340/629, 630, 632, 517, 521, 581, 693.5, 340/693.9, 693.12, 577, 578, 584, 691.1, 340/693.6; 250/573, 574, 381; 356/337, 356/378, 341, 343
See application file for complete search history.

(56) References Cited

U.S. PATENT DOCUMENTS 4,168,438 A * 9/1979 Morisue ..... 250/574
4,642,471 A 2/1987 Güttinger et al.
5,450,066 A 9/1995 Brighenti et al.
5,495,645 A 3/1996 Suzuki et al.
5,497,144 A 3/1996 Schäppi et al.

(Continued)

FOREIGN PATENT DOCUMENTS

DE 10054111 A1 10/2000

(Continued)

*Primary Examiner*—Hung T. Nguyen
(74) *Attorney, Agent, or Firm*—Laurence A. Greenberg; Werner H. Stemer; Ralph E. Locher

(57) ABSTRACT

The fire detector comprises an insertable detector assembly which includes a sensor arrangement, an electronic evaluation system and a housing which surrounds the sensor arrangement and has openings to provide access by air and, when applicable, smoke to the sensor arrangement. The detector is of modular construction and is configured to accommodate detection modules having sensors for different fire parameters, all detection modules being compatible with a single housing. The detection module may be configured for optical, thermal or optical-thermal fire detection and/or for detecting combustion gases. The sensor arrangement and the above-mentioned access openings are arranged substantially in one plane, whereby a shallow construction is achieved even in the case of a multi-criterion detector. The detection modules have a carrier plate which is identical for all detector types and is insertable in the detector, which carrier plate is configured to accommodate the sensors for the different fire parameters.

24 Claims, 4 Drawing Sheets

U.S. PATENT DOCUMENTS

| | | | | |
|---|---|---|---|---|
| 5,523,744 | A | 6/1996 | Wieser | |
| 5,546,074 | A * | 8/1996 | Bernal et al. | 340/628 |
| 5,670,947 | A * | 9/1997 | Nagashima | 340/628 |
| 5,751,218 | A * | 5/1998 | Winterble et al. | 340/693.6 |
| 6,166,648 | A | 12/2000 | Wiemeyer et al. | |
| 6,552,664 | B2 * | 4/2003 | Nishikawa et al. | 340/630 |
| 6,756,905 | B2 * | 6/2004 | Rattman et al. | 340/630 |

FOREIGN PATENT DOCUMENTS

| | | | |
|---|---|---|---|
| EP | 0 821 330 | A1 | 1/1998 |
| EP | 0 658 264 | B1 | 4/1998 |
| EP | 0 926 646 | A1 | 6/1999 |
| EP | 0 636 266 | B1 | 8/2000 |
| EP | 1 049 061 | A2 | 11/2000 |
| EP | 1 087 352 | A1 | 3/2001 |
| EP | 1 166 246 | A1 | 1/2002 |
| JP | 60-99954 | A | 6/1985 |
| JP | 3250395 | A | 11/1991 |
| JP | 07-239988 | A | 9/1995 |
| JP | 10-197417 | A | 7/1998 |
| JP | 2001-175963 | A | 6/2001 |

* cited by examiner

FIRE DETECTOR

BACKGROUND

The present invention relates to a fire detector comprising an insertable detector assembly which includes a sensor arrangement and an electronic evaluation system, and comprising a housing which surrounds the sensor arrangement and has openings to provide access by ambient air and, when applicable, smoke to the sensor arrangement.

The sensor arrangement may include, for example, an electro-optical sensor for detecting scattered light generated by smoke present in the ambient air, or a temperature sensor for detecting heat generated by a fire, or a gas sensor for detecting combustion gases, or combinations of these sensors. In the fire detectors known up to now both the insertable detector assembly and the housing are different, depending on the sensor arrangement used, so that each detector type requires its own injection moulding tool, thereby increasing the manufacturing cost The storage of different types of detector assemblies and housings also causes unwanted costs.

SUMMARY

Through the invention a standardisation of the insertable detector assemblies and housings, and therefore a reduction in costs, are to be made possible. The object pursued is that a single housing can be used for different detector types.

This object is achieved according to the invention in that the detector is of modular construction and is configured to accommodate detection modules for different parameters of fire, all detection modules being compatible with a single housing.

The modular construction comprising one housing and different detection modules compatible therewith gives rise to a universally usable detector with a standardised external appearance. This has an aesthetically pleasing effect and also brings about an appreciable reduction in manufacturing costs.

So-called optical-thermal detectors which include an electro-optical sensor and a temperature sensor are in widespread use today. In these detectors the temperature sensor is in most cases arranged at a level below the electro-optical sensor, preferably on the centre axis of the detector. The above-mentioned access openings are also usually located at this lower level. This gives rise to a "multistorey" structure of the detector which determines its height. In many cases, however, the lowest possible height of the detector is desired for aesthetic reasons.

A further object of the invention is to specify a fire detector having a housing which is compatible with the different detection modules and is of the lowest possible height.

This object is achieved according to the invention in that the sensor arrangement and the above-mentioned access openings are arranged substantially on one level.

The detector according to the invention is therefore a relatively shallow detector which can be used both as a multi-criterion detector and as a single-criterion detector. The low height of the detector is made possible by the arrangement of the sensor arrangement and the access openings on one level.

A first preferred embodiment of the fire detector according to the invention is characterised in that the detection modules have a carrier plate which is usable for all detector types, is insertable in the detector and is configured to receive the sensors for the different fire parameters.

A second preferred embodiment is characterised in that the carrier plate has on its underside facing towards the detector cap housings for receiving components of an electro-optical sensor system and is configured on its upper side for mounting a printed circuit board carrying the electronic evaluation system.

A third preferred embodiment of the fire detector according to the invention is characterised in that the housing includes a detector hood consisting of an annular upper part and a lower part spaced therefrom and forming the cap of the detector. The gap between the two parts of the detector hood forms the above-mentioned access openings and the above-mentioned lower part is connected to the upper part by arcuate or rib-like bridges.

A fourth preferred embodiment is characterised in that there is provided an optical detection module for measuring scattered light caused by smoke, which optical detection module comprises at least one light source, a light detector, a measuring chamber and a labyrinth system having screens arranged at the periphery of the measuring chamber, the at least one light source and the light detector being fixed in the housings on the underside of the carrier plate and the labyrinth system being configured in the manner of a cover and being fixable to the carrier plate.

A further preferred embodiment is characterised in that there is provided a thermal detector module having two temperature sensors which are fixed to the printed circuit board in radially opposed locations and project downwardly therefrom through the carrier plate. A further development of this embodiment is characterised in that the above-mentioned bridges are configured in the form of wings or straps, each having a vertically disposed opening, and are provided in an even number, and in that the temperature sensors project from above towards one of the bridges in each case in such a way that their free ends are located directly in or behind the opening. The thermal detection module includes a cover plate fixable to the carrier plate for covering the housing provided for the electro-optical sensor system, and there are provided in the cover plate openings through which the temperature sensors can pass and a dividing wall disposed radially between the temperature sensors for effecting a directed air-flow.

A further preferred embodiment of the fire detector according to the invention is characterised in that there is provided an optical-thermal detection module for measuring scattered light caused by smoke and for measuring temperature, which detection module includes an electro-optical sensor system and two temperature sensors, the latter being arranged laterally beside the optical sensor system.

According to a further development of this preferred embodiment the temperature sensors are fixed to the printed circuit board in radially opposed locations and their free ends are located in each case in the vicinity of one of the above-mentioned bridges. The bridges are preferably so configured that, firstly, they protect the temperature sensors from mechanical influences and, secondly, they ensure air-flow to the temperature sensors which is as undisturbed as possible.

BRIEF DESCRIPTION OF THE DRAWINGS

The invention is elucidated in detail below with reference to exemplary embodiments and to the drawings, in which.

DETAILED DESCRIPTION

Figure 1:
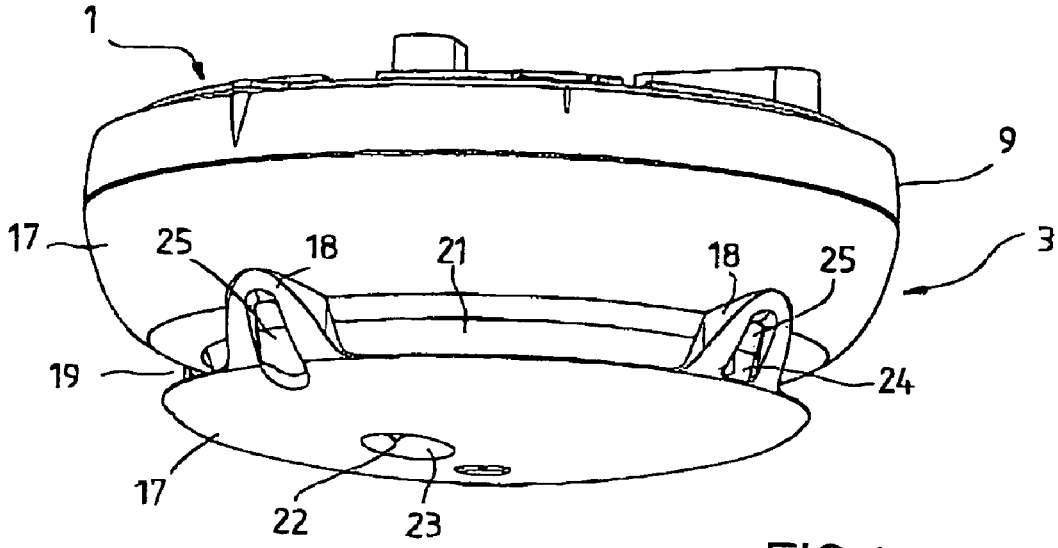
FIG. 1 is a perspective view of a first embodiment of a detector according to the invention seen from the front and below.
Figure 2:
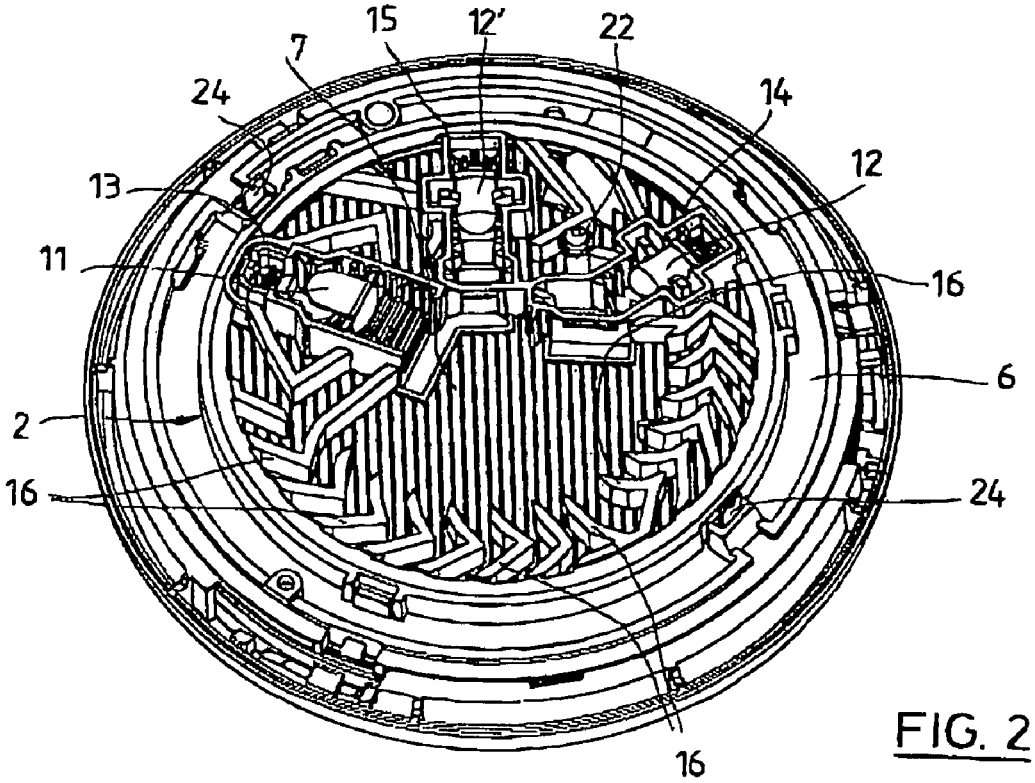
FIG. 2 is a perspective view of a cross-section through the detector of FIG. 1.

The smoke detector illustrated in FIGS. 1 to 5 comprises in known fashion three main components, a base 1, an optical sensor system 2 and a housing 3. This structure is most clearly seen in FIG. 3. FIG. 2 shows a view of a part of the optical sensor system 2 viewed from below in a cross-section through the detector.

The base 1 is provided for mounting to the ceiling of the room to be monitored, mounting being effected either directly to a flush box or to a surface socket with or without additional plinth. The base 1, which consists essentially of a circular plate and a downwardly projecting peripheral flange, contains among other elements a multi-pole connector 4 (FIGS. 3, 4) which is provided to receive a multiple plug 5 (FIG. 5) connected to the sensor system.

The optical sensor system 2 contains a plate-like carrier 6 for the optical sensor, a cover-like labyrinth 7 fixed to the underside of the carrier 6, a printed circuit board 8 arranged on the upper side of the carrier 6 facing towards the base 1 and having the electronic evaluation system, and a cover 9 which closes the printed circuit board 8 peripherally and upwardly and which forms part of the housing 3. The multiple plug 5 is an integrated component of the carrier plate 6 and projects upwardly therefrom. The cover 9 has substantially the form of a plate having a flange around its periphery and having an opening 10 through which the multiple plug 5 can pass so that the latter projects into the plane of the multi-pole connector 4 arranged in the base 1.

The optical sensor which can be seen in FIG. 2 contains a measuring chamber formed by the carrier 6 and the labyrinth 7, and having a light detector 11 and two light sources 12, 12' arranged in housings 13, 14, 15 respectively. These housings consist of a base part in which the respective diode (photodiode or IRED) is mounted and which has on its front side facing towards the centre of the measuring chamber a window opening for the ingress and egress of light. As is apparent from the Figure, the scatter chamber formed in the measuring chamber in the vicinity of the above-mentioned window-like openings in the housings 13, 14, 15 is compact and open. This arrangement and configuration make the detector optimally suited to the use of a transparent body insertable into this scatter chamber for smoke simulation. Such transparent bodies are used for calibrating or testing smoke-sensitivity during manufacture of the detectors (cf. EP-B-0 658 264).

The frames of the window openings are formed in one piece, at least for the housings 14 and 15, whereby the tolerances for smoke-sensitivity are reduced. In known scattered-light smoke detectors the window frames consist of two parts, one of which is integrated with the cover and the other with the base of the measuring chamber. When fitting the base, difficulties of fit constantly occur, giving rise to variable window sizes and to the formation of a light gap between the two halves of the window, and therefore to unwanted disturbances of the transmitted and detected light. With the one-piece housing windows disturbances of this kind are precluded and no problems with the positioning accuracy of the window halves can arise The windows are rectangular or square and there is a relatively large distance between the respective window openings and the associated light sources 12, 12' and the lens of the associated light detector 11, whereby a relatively small aperture angle of the light rays concerned is produced. A small aperture angle of the light rays has the advantage that, firstly, almost no light from the light sources 12, 12' impinges on the base and, secondly, the light detector 11 does not "see" the base, so that dust particles deposited on the base cannot generate any unwanted scattered light. A further advantage of the large distance between the respective windows and the light sources 12, 12' and the lens of the light detector 11 is that the optical surfaces penetrated by light are located relatively deeply inside the housings and therefore are well protected from contamination, resulting in constant sensitivity of the optoelectronic elements.

The labyrinth 7 consists of a floor and peripherally arranged screens 16 and contains flat covers for the above-mentioned housings 13, 14. 15. The floor and the screens 16 serve to shield the measuring chamber from extraneous light from outside and to suppress so-called background light (cf. EP-A-0 821 330 and EP-A-1 087 352). The peripherally arranged screens 16 consist in each case of two sections forming an L-configuration. Through the shape and arrangement of the screens 16, and in particular through their reciprocal distances, it is ensured that the measuring chamber is sufficiently screened from extraneous light while its operation can nevertheless be tested with an optical test set (EP-B-0 636 266). Moreover, the screens 16 are arranged asymmetrically so that smoke can enter the measuring chamber similarly well from all directions.

The front edge of the screens 16 oriented towards the measuring chamber is configured to be as sharp as possible so that only a small amount of light can impinge on such an edge and be reflected The floor and covering of the measuring chamber, i.e. the opposed faces of carrier 6 and labyrinth 7, have a corrugated configuration, and all surfaces in the measuring chamber, in particular the screens 16 and the above-mentioned corrugated surfaces, are glossy and act as black mirrors. This has the advantage that impinging light is not scattered diffusely but is reflected in a directed manner.

The arrangement of the two light sources 12, and 12' is selected such that the optical axis of the light detector 11 includes an obtuse angle with the optical axis of the one light source, light source 12 according to the drawing, and an acute angle with the optical axis of the other light source, light source 12' according to the drawing. The light of light sources 12, 12' is scattered by smoke which penetrates the measuring chamber and a art of this scattered light impinges on the light detector 11, being said to be forward-scattered in the case of an obtuse angle between the optical axes of light source and light detector and being said to be backscattered in the case of an acute angle between said optical axes.

It is known that the scattered light generated by forward-scattering is significantly greater than that generated by back-scattering, the two components of scattered light differing in a characteristic manner for different types of fire. This phenomenon is known, for example, from WO-A-84/01950 (=U.S. Pat. No. 4,642,471), which discloses, among other matters, that the ratio of scatter having a small scattering angle to scatter having a larger scattering angle, which ratio differs for different types of smoke, can be utilised to identify the type of smoke. According to this document, the larger scattering angle may be selected above 90°, so that the forward-scattering and backscattering are evaluated. The evaluation of the scattered light components originating from the two light sources 12 and 12' is not the subject of the present Application and is therefore not described in detail here For better discrimination between different aerosols, active or passive polarisation filters may be provided in the beam path on the transmitter and/or detector side The carrier 6 is suitably prepared and grooves (not shown) in which polarisation filters can be fixed are provided in the housings 13, 14 and 15. As a further option, diodes which transmit a radiation in the wavelength range of visible light (cf. EP-A-0 926 646) may be used as light sources 12, 12', or the light sources may transmit radiation of different wavelengths, for example, one light source transmitting red light and the other blue light.

The housing 3 of the smoke detector is constructed essentially in two parts and consists of the above-mentioned cover 9 and a detector hood 17 surrounding the optical sensor system 2. Said hood 17 consists of an upper annular part and a plate spaced therefrom which forms the cap of the detector and is connected to the upper annular part by arcuate or rib-like bridges 18. The gap, designated by reference numeral 19, between the upper and lower parts of the detector hood 17 forms an opening disposed around the full circumference of the housing to provide access by air and therefore smoke to the optical sensor system 2, this opening being interrupted only by the relatively narrow bridges 18. An even number of bridges 18 are provided, there being four according to the drawings. The detector hood 17 and the cover 9 are fixed to the support 6 by means of hook-like snap connections (not shown) and the whole detector is fixed in the base 1. Recessed in the upper part of the detector hood 17 is a ring 20 which carries an insect mesh 21 made of a suitable flexible material. As the detector hood 17 is fitted the carrier 6 is pressed against the ring 20, whereby the insect mesh 21 is fixed in the detector. The detector is fixed to the base 1 by means of a kind of bayonet connection. The detector is pushed into the base 1 from below, which is possible in only a single relative position between detector and base because of a mechanical coding formed by guide ribs and guide grooves. The detector is then rotated in the base 1 through an angle of approximately 20° (FIG. 4), whereby the multiple plug 5 forming part of the carrier 6 and projecting upwardly therefrom is inserted tangentially into the multi-pole connector mounted in the base 1 and electrical contact between the multi-pole connector 4 and the multiple plug 5, and therefore between detector and base, is established. The detector is then mechanically fixed into the base 1 by means of the above-mentioned bayonet connection. The multiple plug 5 is integrated with the upper face of the carrier 6 and manufactured in one piece with the carrier 6 using so-called insert technology. The electrical connections are taken from the plug contacts of the multiple plug 5 to a stamped part moulded into the carrier 6 by means of metal conductors insulated from one another The free ends of these metal conductors project from the carrier 6 beside the multiple plug 5 and form contact points for producing soldered connections to the electronic evaluation system on the printed circuit board 8.

The electrical connection between detector and base by means of the two elements: multi-pole connector 4 and multiple plug 5, has a number of advantages:

- a simple mechanical action is required to establish the plug connection and, in particular, no conversion of a rotary into a translational motion is required;
- the compact plug connection permits the use of simple loop contacts and possesses excellent characteristics with regard to electromagnetic compatibility (EMC).

Figure 3:
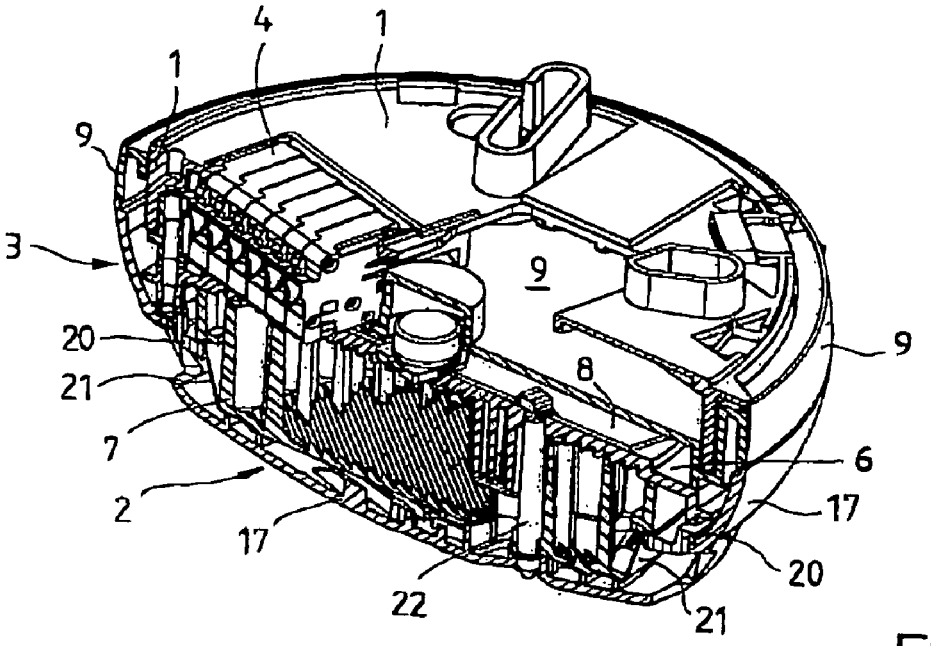
FIG. 3 is a perspective view of an axial section through the detector of FIG. 1.
Figure 4:
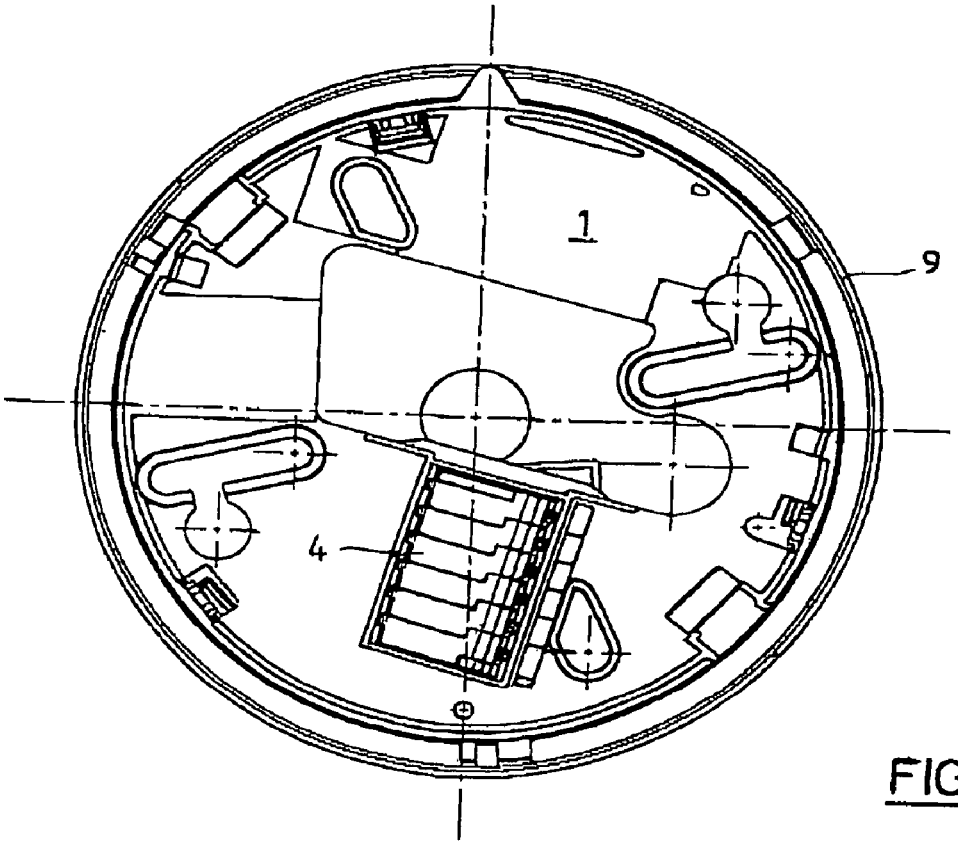
FIG. 4 is a plan view of the detector of FIG. 1.
Figure 5:
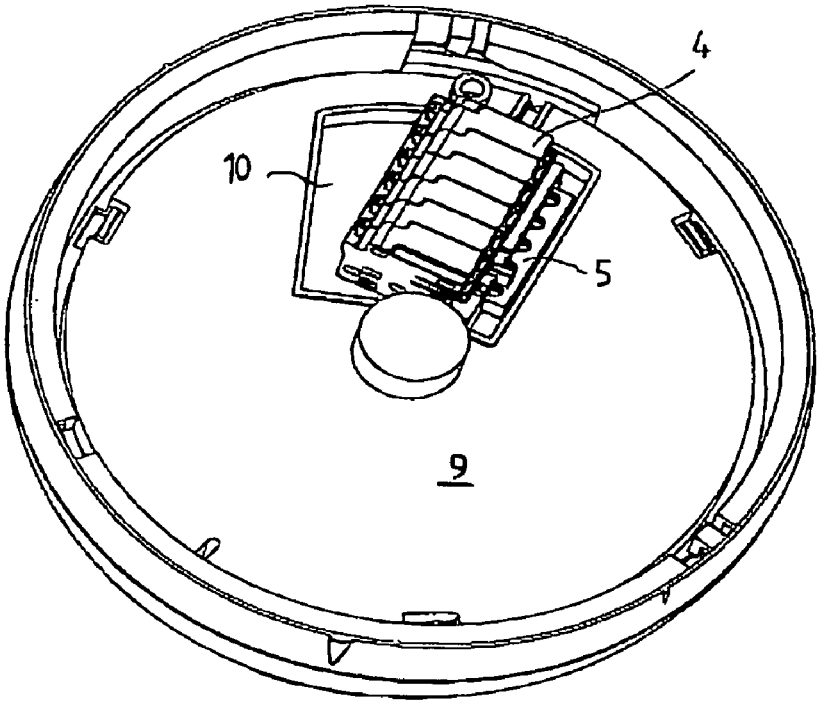
FIG. 5 is a perspective representation of a top view of the detector of FIG. 1 without base but with base terminal.

As is apparent from FIG. 3, a light guide 22 is fixed to the component forming the floor of the labyrinth 7, one end of which light guide 22 projects upwardly to the printed circuit board 8 while its other end projects from the detector hood 17 through a hole in the lower part of the detector hood. In the region of said hole the detector hood is provided with a spherical recess 23 which surrounds the free end of the light guide 22. The light guide 22 therefore serves as an alarm indicator for optical display of alarm states of the detector.

For this purpose an LED (not shown) which is activated in an alarm state and supplies light to the light guide 22 is provided on the printed circuit board 8.

If a detector executes an alarm signal, as a rule a visual check is made to determine whether the alarm indicator is actually displaying an alarm. It is evident that the alarm indicator must be visible from all sides in order to make this check. Where this is not the case the detectors must be mounted in the room monitored in such a way that the alarm indicator is clearly visible from the doorway. In the case of purely thermal detectors in which, because of the absence of an optical sensor, there are no restrictions on the arrangement of the alarm indicator, the latter is often arranged at the apex of the detector (cf. U.S. Pat. No. 5,450,066). In the case of scattered-light smoke detectors this is possible only with restrictions because, firstly, a light guide mounted on the axis of the detector, and therefore passing through the scatter chamber, is out of the question, so that a curved light guide would have to be used and, secondly, the electrical connection to an LED mounted at the apex of the detector would be too complex and costly. For this reason, in the case of scattered-light smoke detectors, the alarm indicator is as a rule arranged at the periphery of the detector (cf. DE-A-100 54 111) and in practice is visible from only a very small solid angle, giving rise to the above-mentioned problems with regard to mounting and positioning the detectors Proposals regarding all-round visibility of the alarm indicator of scattered-light smoke detectors tend in the direction of annular or strip-like light guides around the entire periphery of the detector hood (EP-1 049 061). However, these solutions are not satisfactory because a light guide with such a large luminous surface requires a relatively large amount of current in order to shine brightly enough to ensure reliable detection of alarm displays.

The alarm indicator requires only a small amount of current and, because it is located in the region of the apex of the detector, is visible practically on all sides. It is true that all-round visibility exists only from a viewing angle of 20° to the horizontal, but because the detector is mounted to the ceiling this condition is fulfilled in most cases. As can be seen in particular in FIG. 2, the light guide 22 passes through the measuring chamber in the area between the housings 14 and 15. The two housings 14 and 15 are connected together by their front faces and therefore form, with their inner side faces and the connecting face between the latter, a wall surrounding the light guide 22 which largely screens the scatter chamber of the measuring chamber from the light guide 22.

The smoke detector described heretofore is a purely optical detector with smoke detection making use of the scattered light caused by smoke particles which have penetrated the measuring chamber. The detector may optionally be configured as a dual-criterion detector and additionally include a temperature sensor. According to FIGS. 1 and 2, two temperature sensors 24 formed by NTC resistors are provided which are arranged in the vicinity of two bridges 18 located opposite one another. The bridges 18 have at their centre an elongated aperture 25 into which the temperature sensors 24, which are mounted on the printed circuit board 8, project from above. Optical-thermal detectors are known, so that a description of the signal evaluation process may be omitted here. The detector could, of course, include still further sensors, for example, a combustion gas sensor (CO, $NO_x$), which, if of appropriately small dimensions, could be arranged inside the measuring chamber.

Whereas temperature sensors arranged on the axis of the detector are completely independent of direction, in the case of a peripherally arranged sensor directional dependence is high and response behaviour depends on whether the sensor is located on the side of the detector facing towards or away from the fire. This problem is solved by the use of two temperature sensors 24 located opposite one another. Further details on these sensors are to be found in the description of FIGS. 6 to 8. What is essential is that the sensor has homogeneous, rotationally symmetrical sensitivity regardless of the incoming flow direction. This is achieved by the bridges 18 in cooperation with the labyrinth 7, the bridges 18 on the one hand protecting the temperature sensors 24 against the effects of mechanical forces and conducting the air optimally to the sensors and, on the other, guiding the air along the outside of the housing in cooperation with the labyrinth 7.

As already mentioned in the introduction to the description, optical, optical-thermal and thermal fire detectors are in use today, to which gas detectors may also be added. Moreover, the optical, thermal and optical-thermal detectors may additionally include a combustion gas sensor. The detector illustrated in FIGS. 1 to 5 represents the optical and optical-thermal variants (supplemented by the combustion gas sensor, if applicable), no temperature sensors 24 being present, of course, in the case of the purely optical detector. Apart from these differences, the mechanical construction of the detectors in the two variants described heretofore is identical.

Figure 6:
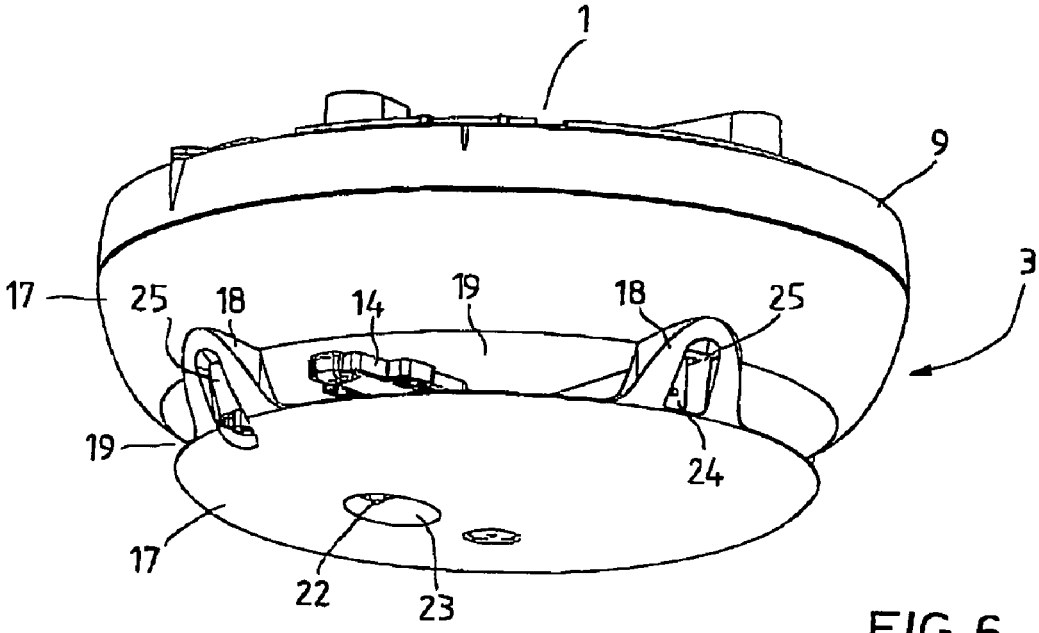
FIG. 6 is a perspective view of a second embodiment of a detector according to the invention seen from the front and below.
Figure 7:
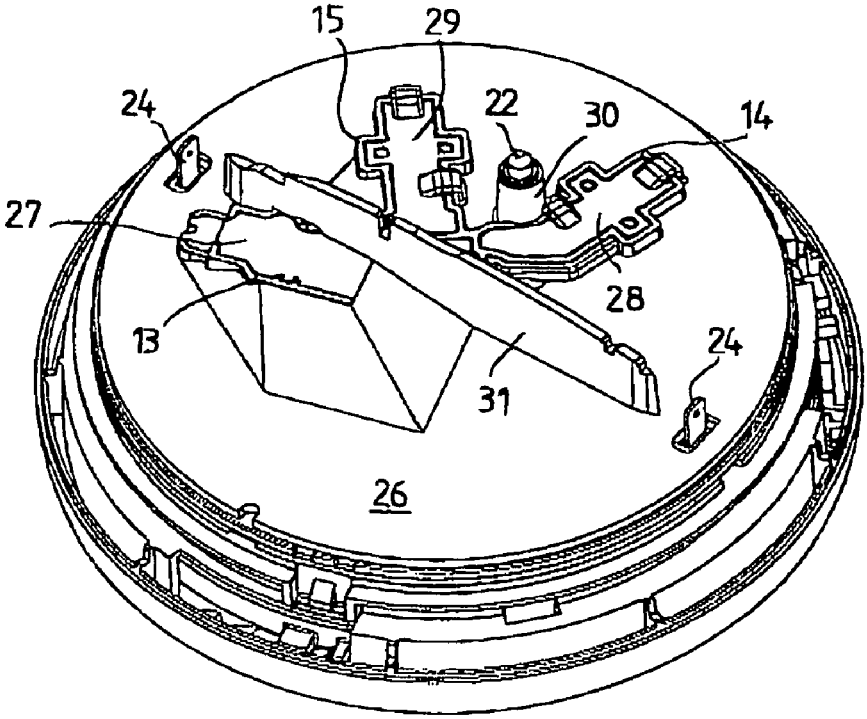
FIG. 7 is a perspective view of the detector of FIG. 6 with the detector cap removed, seen from below.
Figure 8:
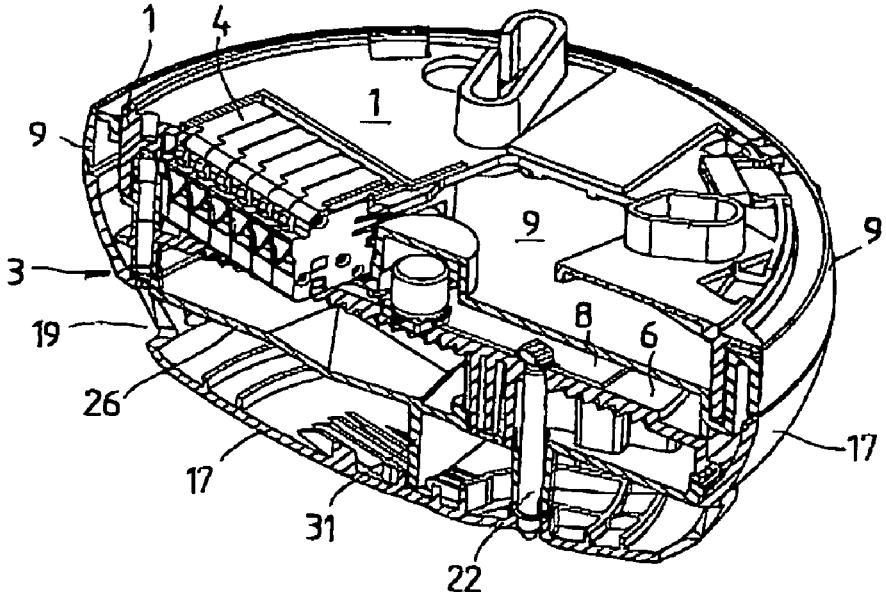
FIG. 8 is a perspective view of an axial section through the detector of FIG. 6.

As will now be elucidated with reference to FIGS. 6 to 8, without design changes to the base or housing the detector may also be used as the basis for a purely thermal detector. Because the main mechanical components and the structure of the detector are therefore always the same in all cases, there is proposed a family of fire detectors having sensors for different fire parameters for which a single housing identical in all cases and a single base are sufficient, whereby substantial savings are made possible.

The thermal fire detector represented in FIGS. 6 to 8 differs from the optical-thermal detector represented in FIGS. 1 to 5 essentially by the following features:

- the light sources 12 and 12' and the light detector 11 are omitted;
- the ring 20 and the mesh 21 are omitted;
- the labyrinth 7 is omitted and replaced by a cover plate 26.

The cover plate 26 is a very fundamental part of the thermal fire detector because it makes possible, among other features, for one and the same carrier 6 to be used for the different types of detector. As can be seen in particular in FIG. 7, which shows a view of the cover plate 26 from below, the latter includes openings adapted to the contours of the housings 13, 14 and 15, through which the lower ends of the above-mentioned housings project. In addition, elastic tongues 27, 28 and 29 are provided on the cover plate 26, which serve to cover the housings 13, 14, 15 and are snapped into same. Furthermore, the cover plate 26 includes a tubular mounting 30 for the light guide 22, two openings for the temperature sensors 24 and a dividing wall 31, which is disposed between the latter and serves to effect a directed air flow.

The dividing wall 31 contributes substantially to enabling the above-described thermal fire detector to have homogeneous sensitivity and to meet the strict requirements of standard EN 54/5, Class A1. Together with the bridges 18, the dividing wall 31 guides the inflowing air through the housing to the sensors 24.

In evaluating the signals of the two temperature sensors 24, either the higher value or the mean value may be taken into account, or the two values may be weighted and used jointly for evaluation. The response behaviour of the temperature sensors gives an indication of the location of the fire, since it can be assumed that the fire is located on the side of the detector having the sensor which supplies the higher temperature value.

A further advantage of the use of two temperature sensors 24 is the redundancy associated therewith. The two sensors monitor one another, and drift or ageing is detectable considerably earlier than in the case of a single sensor. The monitoring of the two sensors over a relatively long period must yield approximately the same temperature for both. If this is not the case, a malfunction is present in one of the sensors.

In the case of the optical-thermal detector illustrated in FIGS. 1 to 5, optimum redundancy (two light transmitters, two light detectors, two temperature sensors) can be achieved by using a double photodiode as the light detector 11.

FIGS. 1 to 8 do not illustrate a single detector but a detector system which is characterised by three main features:

- all detectors have the same appearance, at least when viewed from the usual distance of more than 2 m;
- the detectors are shallow and "single-storey";
- the detectors are of modular construction and therefore are cost-effective to manufacture.

Each detector of the system, whether a single-criterion or a multi-criterion detector and whether optical or thermal, has the same base 1, the same housing 3 and the same carrier 6. The individual detectors differ only in the detection module, i.e. the particular sensor arrangement used. The detection module for an optical detector consists of the carrier 6, the optoelectronic elements 11, 12, 12', the labyrinth 7 and the mesh 21 with the ring 20; the detection module for a thermal detector consists of the carrier 6, the thermal sensors 24 and the cover plate 26, and the detection module for an optical-thermal detector consists of the carrier 6, the optoelectronic elements 11, 12, 12', the labyrinth 7, the mesh 21 with the ring 20 and the thermal sensors 24, the printed circuit board 8 being, of course, specific to the type of detector.

A detector module for a gas detector is also possible as an additional detection module, the sensor concerned also being mounted, where possible, on the carrier. A different possibility consists in arranging the gas sensor laterally beside the fire detector or in a separate housing offset from the detector and preferably arranged laterally beside same or moulded therewith. Possibilities for further modules are, for example, a module for measuring radiation power, a camera or an alarm module with an acoustic alarm emitter (cf. EP 01 128 683.8).

The invention claimed is:

1. A fire detector, comprising an insertable detector assembly which includes a sensor arrangement and an electronic evaluation system, and a housing which surrounds the sensor arrangement and has openings to provide access by air and, when applicable, smoke to the sensor arrangement, wherein the detector is of modular construction and is configured to accommodate mutually different detector modules having sensors for different fire parameters, all detection modules being compatible with a single housing, wherein the sensor arrangement and the access openings are arranged substantially in one plane, and wherein the detection modules have an identical carrier plate for all detector types, the carrier plate insertable in the housing and configured to accommodate the sensors for the different fire parameters.

2. The fire detector of claim 1, wherein the carrier plate includes, on its underside facing towards a detector cap, housings for accommodating components of an electro-optical sensor system and is configured on its upper side for mounting a printed circuit board carrying the electronic evaluation system.

3. The fire detector of claim 2, wherein the housing includes a detector hood comprising an annular upper part and a lower part spaced therefrom and forming the cap of the detector.

4. The fire detector of claim 3, wherein a gap between the two parts of the detector hood forms the access openings and the lower part is connected to the upper part by bridges.

5. The fire detector of claim 4, further comprising a thermal detection module having two temperature sensors which are fixed to the printed circuit board radially opposite one another and project downwardly from the latter through the carrier plate.

6. The fire detector of claim 5, wherein the bridges are configured in the form of wings or straps having a vertically disposed opening and are provided in an even number, and in that the temperature sensors project from above towards one of the bridges in each case in such a way that their free ends are located directly in or behind the opening.

7. The fire detector of claim 6, wherein the thermal detection module has a cover plate fixable to the carrier plate for covering the housings which are provided for the electro-optical sensor system, and in that openings through which the temperature sensors can pass are provided in the cover plate and a dividing wall for effecting a directed air-flow is provided between the temperature sensors and is disposed in a radial direction.

8. The fire detector of claim 6, wherein the bridges are so configured that they protect the temperature sensors from mechanical influences and ensure air-flow to the temperature sensors which is substantially undisturbed.

9. The fire detector of claim 4, further comprising an optical-thermal detection module for measuring scattered light caused by smoke and for measuring temperature, which detection module includes the electro-optical sensor system and two temperature sensors, the latter being arranged laterally beside the optical sensor system.

10. The fire detector of claim 4, further comprising an alarm module having an acoustic alarm emitter arranged in a separate housing offset from the housing of the fire detector.

11. The fire detector of claim 2, and further comprising an optical detection module for measuring scattered light caused by smoke including at least one light source, a light detector, a measuring chamber and a labyrinth system having screens arranged at its periphery, the at least one light source and the light detector being fixed in the housings on the underside of the carrier plate and the labyrinth system being formed in the manner of a cover and being fixable to the carrier plate.

12. The fire detector of claim 11, further comprising a light guide is fixed to the base of the labyrinth system, which light guide extends upwardly to the printed circuit board and forms part of an alarm display visible in the region of the apex of the detector.

13. The fire detector of claim 12, further comprising a base associated with the housing of the fire detector and having a multi-pole connector, and by a multiple plug arranged in the housing of the fire detector and insertable tangentially in the multi-pole connector by rotating the housing of the detector relatively to the base.

14. The fire detector of claim 13, wherein the multiple plug is integrated in the carrier plate using insert technology.

15. The fire detector of claim 14, further comprising an alarm module having an acoustic alarm emitter arranged in a separate housing offset from the housing of the fire detector.

16. The fire detector of claim 1, wherein the temperature sensors are fixed to the printed circuit board radially opposite one another and their free ends are located in the vicinity of the bridges.

17. The fire detector of claim 16, wherein the bridges are so configured that they protect the temperature sensors from mechanical influences and ensure air-flow to the temperature sensors which is substantially as undisturbed.

18. The fire detector of claim 1, further comprising an alarm module having an acoustic alarm emitter arranged in a separate housing offset from the housing of the fire detector.

19. A fire detector comprising:

a detector module which includes a sensor arrangement and an electronic evaluation system;

a housing surrounding the sensor arrangement and having openings to provide access by air and, when applicable, smoke to the sensor arrangement;

wherein the fire detector is of modular construction and the detector module is one of a plurality of different types of detector modules, each of the different types of detector modules having a different set of components including a different sensor for a different fire parameter, and each of the different types of detector modules being compatible within the housing, wherein each of the different types of detector modules comprise an identical carrier plate which is insertable in the housing for selectively rendering the fire detector capable of sensing a given fire parameter.

20. The fire detector arrangement of claim 19 wherein one of the plurality of different types of modules comprises at least one light source and at least one light detector and another of the plurality of different types of modules does not comprise the at least one light source and the at least one light detector.

21. The fire detector according to claim 19, wherein said first sensor assembly comprises at least one light source and at least one light detector for optical detection, and said second sensor assembly includes a temperature sensor.

22. The fire detector according to claim 21, wherein said first sensor assembly further includes a temperature sensor.

23. A fire detector comprising:

a fire detector housing formed with air access openings through which air and, if applicable, smoke may enter into an interior of said housing;

a first detector module carrying a set of components including a first sensor assembly configured to detect a first fire parameter;

a second detector module carrying a set of components including a second sensor assembly configured to detect a second fire parameter different from the first fire parameter;

wherein the interior of said housing is formed to receive therein either said first detector module or said second detector module for rendering the fire detector capable of detecting the first fire parameter or the second fire parameter, respectively, and wherein the interior of said housing is formed to accommodate either the first sensor assembly or the second sensor assembly, depending on whether the first detector module or the second detector module is inserted in said housing, at a location substantially in a common plane with said air access openings formed in said housing.

24. The first detector according to claim 23, wherein each of said first and second detector modules comprises an identical carrier plate configured for insertion into said fire detector housing.

* * * * *